US007412956B2

(12) United States Patent
Gotou et al.

(10) Patent No.: US 7,412,956 B2
(45) Date of Patent: Aug. 19, 2008

(54) REINFORCING STRUCTURE OF CYLINDER BARREL

(75) Inventors: Mitsunori Gotou, Tokyo (JP); Tadashi Hiraga, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 185 days.

(21) Appl. No.: 11/411,101

(22) Filed: Apr. 26, 2006

(65) Prior Publication Data

US 2006/0255047 A1 Nov. 16, 2006

(30) Foreign Application Priority Data

May 11, 2005 (JP) ..... 2005-138461

(51) Int. Cl.
*F02F 1/00* (2006.01)

(52) U.S. Cl. ..... 123/193.2; 220/581; 220/587; 138/150; 156/380.1

(58) Field of Classification Search ..... 220/587–591, 220/581; 156/218, 380.1; 138/150; 123/193.2
See application file for complete search history.

(56) References Cited

U.S. PATENT DOCUMENTS 2,301,235 A * 11/1942 Willgoos ..... 123/41.69
2,879,116 A * 3/1959 Goetze ..... 165/133
2,965,220 A * 12/1960 Naul ..... 206/524.9
3,141,479 A * 7/1964 Mickey ..... 138/143
3,536,123 A * 10/1970 Izumi ..... 164/114
3,568,723 A * 3/1971 Sowards ..... 138/143
3,808,955 A * 5/1974 Hamada et al. ..... 92/169.1
3,830,173 A * 8/1974 Hubble et al. ..... 138/114
4,044,217 A * 8/1977 Otsuki et al. ..... 219/78.11
4,352,705 A * 10/1982 Ozaki et al. ..... 156/155
4,495,907 A * 1/1985 Kamo ..... 123/193.2
4,523,554 A * 6/1985 Ryu ..... 123/193.2
4,853,165 A * 8/1989 Rosenzweig et al. ..... 264/450
4,921,734 A * 5/1990 Thorpe et al. ..... 428/34.4
5,052,446 A * 10/1991 Gysin ..... 139/93
5,148,780 A * 9/1992 Urano et al. ..... 123/193.2
RE34,143 E * 12/1992 Rao et al. ..... 123/193.4
5,535,604 A * 7/1996 Rodrigues et al. ..... 68/28
5,581,881 A * 12/1996 Sherman et al. ..... 29/888.061
5,749,331 A * 5/1998 Pettersson et al. ..... 123/193.2
5,829,405 A * 11/1998 Godel ..... 123/193.2
6,041,749 A * 3/2000 Lubbing et al. ..... 123/193.2

(Continued)

FOREIGN PATENT DOCUMENTS

JP 2004-324852 11/2004

*Primary Examiner*—Anthony Stashick
*Assistant Examiner*—Christopher B McKinley
(74) *Attorney, Agent, or Firm*—Rabin & Berdo, PC

(57) ABSTRACT

A cylinder barrel (1) for housing a piston comprises a sheet metal liner (2) and a reinforcing structure (10) located outside the sheet metal liner (2). The reinforcing structure (10) comprises a glass-fiber-reinforcing layer (12) and a carbon-fiber-reinforcing layer (13). The glass-fiber-reinforcing layer (12) comprises a plain cloth (20) made of glass fiber covering the sheet metal liner (2). The carbon-fiber-reinforcing layer (13) comprises a carbon fiber string (31) wound around the outer circumference of the glass-fiber-reinforcing layer (12) along a spiral path. According to the this construction, the reinforcing structure (10) has a high flexibility which is required for preventing cracks in the reinforcing structure (10) while maintaining a high rigidity of the entire cylinder barrel (1).

4 Claims, 2 Drawing Sheets

U.S. PATENT DOCUMENTS

| | | | | |
|---|---|---|---|---|
| 6,044,820 | A * | 4/2000 | Domanchuk et al. | 123/193.2 |
| 6,419,775 | B1 * | 7/2002 | Gibson et al. | 156/137 |
| 6,886,521 | B2 * | 5/2005 | Hamada et al. | 123/193.4 |
| 7,255,083 | B2 * | 8/2007 | Hamada et al. | 123/193.4 |
| 2001/0037786 | A1 * | 11/2001 | Fischer et al. | 123/193.2 |
| 2003/0087079 | A1 * | 5/2003 | Okabe et al. | 428/304.4 |
| 2003/0159777 | A1 * | 8/2003 | Tsujimoto et al. | 156/309.6 |
| 2004/0065290 | A1 * | 4/2004 | Wakade et al. | 123/193.2 |
| 2005/0224174 | A1 * | 10/2005 | Tsujimoto et al. | 156/324 |
| 2005/0274333 | A1 * | 12/2005 | Rau et al. | 123/41.84 |
| 2006/0118194 | A1 * | 6/2006 | Mechler et al. | 138/125 |

* cited by examiner

REINFORCING STRUCTURE OF CYLINDER BARREL

FIELD OF THE INVENTION

This invention relates to the structure of a cylinder barrel used for a hydraulic actuator, a hydraulic or compressed-air accumulator, a gas bottle, etc.

BACKGROUND OF THE INVENTION

A hydraulic actuator which is mounted on an air craft, for example, requires a light weight cylinder barrel for housing a reciprocating piston.

In order to reduce the weight of the cylinder barrel, a known method is to construct the cylinder barrel using a thin sheet metal liner reinforced with a reinforcing structure made of glass fiber or carbon fiber.

The thin sheet metal liner is formed in a cylindrical shape and string made of glass fiber or carbon fiber is wound around the outer circumference of the sheet metal liner. The string wound around the sheet metal liner is then cemented by a resin. The reinforcing structure thus formed increases the rigidity of the cylinder barrel.

With respect to such a reinforcing structure, although not for a cylinder barrel, JP2004-324852A issued by Japan Patent Office in 2004, proposes that a valve body of a solenoid valve be reinforced with glass fiber or carbon fiber.

SUMMARY OF THE INVENTION

In a cylinder barrel, the sheet metal liner elastically deforms due to the pressure of working fluid introduced into the cylinder barrel. Following the deformation of the sheet metal liner, the reinforcing structure made of reinforcing fiber and resin tends to deform, but due to its high rigidity, the reinforcing structure is apt to have cracks.

It is therefore an object of this invention to increase the flexibility of a reinforcing structure while maintaining the overall rigidity of a cylinder barrel.

In order to achieve the above object, this invention provides a reinforcing structure of a cylinder barrel, the cylinder barrel having a sheet metal liner for housing a piston which displaces according to a fluid pressure introduced into the sheet metal liner.

The reinforcing structure comprises a glass-fiber-reinforcing layer comprising a cloth made of glass fiber and wrapping the sheet metal liner, and a carbon-fiber-reinforcing layer comprising a carbon fiber string wound around the outer circumference of the glass-fiber-reinforcing layer along a spiral path and cemented by a resin.

The details as well as other features and advantages of this invention are set forth in the remainder of the specification and are shown in the accompanying drawings.

DESCRIPTION OF THE PREFERRED EMBODIMENTS

Figure 1:
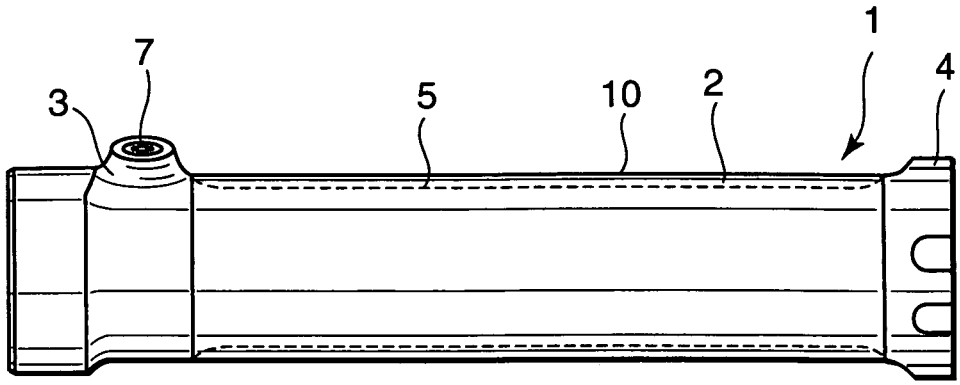
FIG. 1 is a side view of a cylinder barrel according to this invention.
Figure 2:
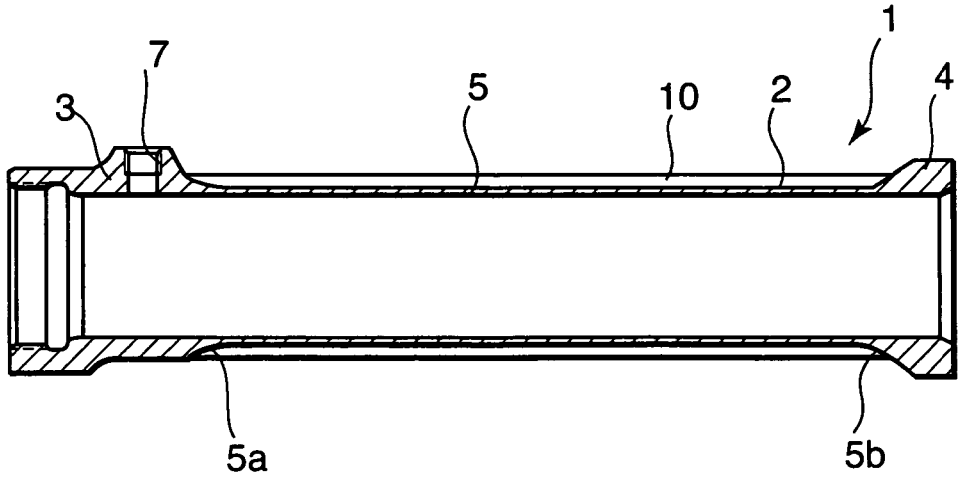
FIG. 2 is a longitudinal sectional view of the cylinder barrel.

Referring to FIG. 1 and FIG. 2 of the drawings, a cylinder barrel 1 forms a part of a hydraulic actuator mounted on an air craft, for example. The cylinder barrel 1 comprises a sheet metal liner 2 and a reinforcing structure 10 surrounding the sheet metal liner 2. In an operative state of the actuator, a piston slides on the inner circumference of the sheet metal liner 2.

By thus increasing the rigidity of the cylinder barrel 1 with the reinforcing structure 10, use of a thin sheet metal liner 2 is enabled, and the cylinder barrel 1, or in other words the hydraulic actuator can be reduced in weight.

The sheet metal liner 2 comprises a rod side tip 3 which supports a piston rod so as to be free to project from the cylinder barrel 1, an end side tip 4 which is closed by a plug member, and a main body 5 extending between the rod side tip 3 and the end side tip 4. The rod side tip 3 has a through hole 7 through which hydraulic fluid is introduced into the cylinder barrel 1 when the actuator is operative.

The main body 5 is formed by a sheet metal in the shape of a straight cylinder. The wall thickness of the main body 5 is constant both in a liner direction and a circumferential direction except at tapered portions 5*a* and 5*b*. The wall thickness of the rod side tip 3 and end side tip 4 is greater than that of the main body 5. In order to connect two parts having different wall thicknesses, the tapered portion 5*a* has a conical shape and is formed in the main body 5 so as to increase the wall thickness of the main body 5 towards the rod side tip 3. The conical tapered portion 5*b* is also formed in the main body 5 so as to increase the wall thickness of the main body 5 towards the end side tip 4.

Figure 3:
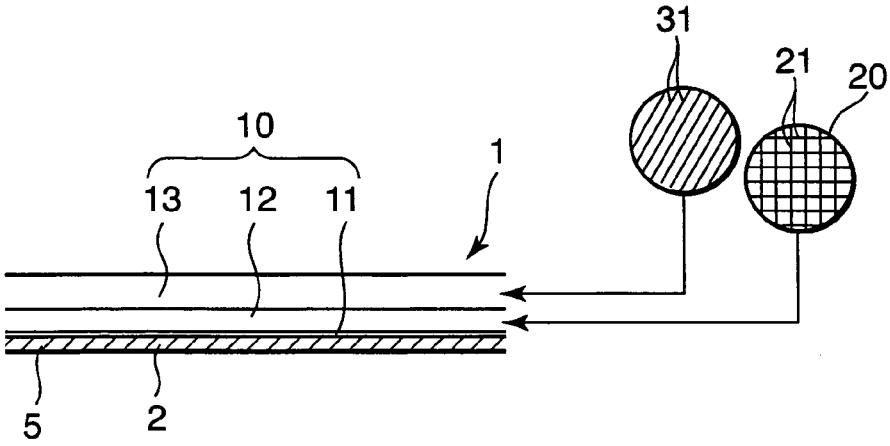
FIG. 3 is a cross sectional view of a sheet metal liner and a reinforcing structure of the cylinder barrel.
Figure 4:
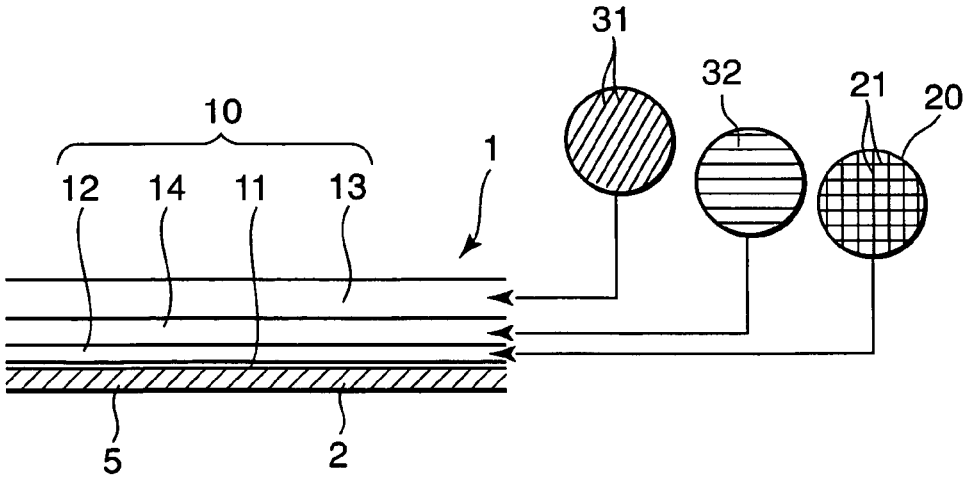
FIG. 4 is similar to FIG. 3, but shows another embodiment of this invention.

Referring to FIG. 3, the reinforcing structure 10 comprises a resin layer 11, a glass-fiber-reinforcing layer 12 and a carbon-fiber-reinforcing layer 13.

The resin layer 11 is an adhesive thin layer coated onto the outer circumference of the sheet metal liner 2.

The glass-fiber-reinforcing layer 12 comprises a plain cloth 20 made of glass fiber strings 21. The plain cloth 20 is wrapped around the outer circumference of the resin layer 11, and is cemented by a resin. The glass-fiber-reinforcing layer 12 is adhered onto the outer circumference of the sheet metal layer 2 by the adhesion force of the resin layer 11.

The carbon-fiber-reinforcing layer 13 is made of a carbon fiber string 31 wound around the outer circumference of the glass-fiber-reinforcing layer 12 and is cemented by a resin. The carbon-fiber-reinforcing layer 13 is adhered onto the outer circumference of the glass-fiber-reinforcing layer 12 by the adhesion force of the resin.

The plain cloth 20 is woven by warp yarn and weft yarn respectively made of glass fiber strings 21. The plain cloth 20 is applied to cover the outer circumference of the resin layer 11 such that the warp yarn is parallel to a center axis of the cylinder barrel 1 while the weft yarn runs along the circumferential direction of the cylinder barrel 1.

The carbon fiber string 31 forming the carbon-fiber-reinforcing layer 13 is wound numerous times around the outer circumference of the glass-fiber-reinforcing layer 12 following a spiral path. The carbon fiber string 31 wound around the outer circumference of the glass-fiber-reinforcing layer 12 is then cemented by the resin to form the carbon-fiber-reinforcing layer 13. The angle between the spiral path and the center axis of the cylinder barrel 1 is herein set at eighty five (85) degrees, for example. The carbon fiber string 31 is coated with the resin in advance and wound around the glass-fiber-reinforcing layer 12 together with the resin.

The thickness of the resin layer 11, glass-fiber-reinforcing layer 12, and carbon-fiber-reinforcing layer 13 may be determined arbitrarily according to the required rigidity of the cylinder barrel 1. Typical values are 0.3 millimeters (mm) for the resin layer 11, and 0.5 mm for the glass-fiber-reinforcing layer 12. The thickness of the carbon-fiber-reinforcing layer 13 is set to be greater than that of the glass-fiber-reinforcing layer 12. The above values of the thickness are those measured in a radial direction of the cylinder barrel 1.

The cylinder barrel 1 thus constructed comprises the sheet metal liner 2 on which the piston slides when it displaces according to a fluid pressure provided via the through hole 7, and the reinforcing structure 10 surrounding the sheet metal liner 2.

The reinforcing structure 10 is a composite structure of the glass-fiber-reinforcing layer 12 made of the plain cloth 20, in which the warp yarn made of glass fiber string 21 is arranged parallel to the center axis of the cylinder barrel 1 while the weft yarn made of glass fiber string 21 is arranged along the circumferential direction of the cylinder barrel 1, and the carbon-fiber-reinforcing layer 13 in which the carbon fiber string 31 is wound around the outer circumference of the glass-fiber-reinforcing layer 12 following a spiral path, for supporting the sheet metal liner 2.

When the actuator is operative, in response to an increase in the fluid pressure introduced into the cylinder barrel 1, the sheet metal liner 2 elastically deforms in the axial direction as well as in the circumferential direction. Accordingly, in the glass-fiber-reinforcing layer 12, the warp yarn made of glass fiber string 21 extends in the axial direction of the cylinder barrel 1 whereas the weft yarn made of glass fiber string 21 extends in the circumferential direction of the cylinder barrel 1, thereby preventing cracks from occurring in the glass-fiber-reinforcing layer 12 and the carbon-fiber-reinforcing layer 13. The reinforcing structure 10 thus constructed has a higher flexibility than that of the prior art while preserving the rigidity of the cylinder barrel 1.

When the fluid pressure is applied to the cylinder barrel 1 through the through hole 7, a hoop stress is generated in the cylinder barrel 1. The sheet metal liner 2 and the carbon-fiber-reinforcing layer 13 made by spiral-winding the carbon fiber string 31 bear this hoop stress. The sheet metal liner 2 also bears a buckling stress which may be generated in the cylinder barrel 1. According to this reinforcing structure 10, therefore, the entire rigidity of the cylinder barrel 1 is also enhanced.

To summarize the above, prevention of cracks in the reinforcing structure 10 is realized while maintaining the entire rigidity of the cylinder barrel 1.

It should also be noted that the resin layer 11 and the glass-fiber-reinforcing layer 12 disposed between the sheet metal layer 2 and the carbon-fiber-reinforcing layer 13 function to prevent the carbon-fiber-reinforcing layer 13 from detaching from the sheet metal layer 2 as well as to prevent electric corrosion of the sheet metal layer 2.

Next, referring to FIG. 3, another embodiment of this invention will be described. In the figure, identical reference numerals are assigned to the same components as in the first embodiment.

This embodiment differs from the first embodiment in the construction of the reinforcing structure 10. Specifically, in this embodiment, the glass-fiber-reinforcing layer 12 is formed on the outer circumference of the sheet metal liner 2 as in the case of the first embodiment, but a prepreg-reinforcing layer 14 is formed between the glass-fiber-reinforcing layer 12 and the carbon-fiber-reinforcing layer 13.

The prepreg-reinforcing layer 14 is formed by wrapping the glass-fiber-reinforcing layer 12 in a sheet made of prepreg strings 32 arranged in one direction and cementing the sheet with a resin. The prepreg string 32 is a string of carbon previously impregnated with a resin. The glass-fiber-reinforcing layer 12 is wrapped in the prepreg sheet such that the prepreg strings 32 are disposed parallel to the center axis of the cylinder barrel 1, or in other words such that the angle subtended by the center line and the prepreg strings 32 is zero.

In this embodiment also, when the fluid pressure in the sheet metal liner 2 increases, the sheet metal liner 2 deforms in the axial and circumferential directions, and accordingly the warp yarn and weft yarn forming the glass-fiber-reinforcing layer 12 elongate in the respective directions. According to this embodiment, therefore, a favorable effect in terms of preventing cracks from occurring in the reinforcing structure 10 is obtained as in the case of the first embodiment.

The sheet metal liner 2 and the carbon-fiber-reinforcing layer 13 bear the hoop stress generated in the cylinder barrel 1 as in the case of the first embodiment.

In this embodiment, the sheet metal liner 2 and the prepreg-reinforcing layer 14 bear the buckling stress in the cylinder barrel 1, and hence the rigidity of the cylinder barrel 1 is further enhanced with respect to the first embodiment. The sheet metal liner 2 can accordingly be made even thinner by providing the prepreg-reinforcing layer 14 in the reinforcing structure 10, thereby enabling a cylinder barrel 1 that is even lighter than in the case of the first embodiment.

The contents of Tokugan 2005-138461, with a filing date of May 11, 2005 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, the cylinder barrel 1 according to this invention is applicable to various hydraulic pressure/air pressure equipment including a hydraulic actuator, a hydraulic or air pressure accumulator, and a gas bottle.

What is claimed is:

1. A reinforcing structure of a cylinder barrel, the cylinder barrel having a sheet metal liner for housing a piston which displaces according to a fluid pressure introduced into the sheet metal liner, comprising:

a glass-fiber-reinforcing layer comprising a cloth made of glass fiber and wrapping the sheet metal liner; and a carbon-fiber-reinforcing layer comprising a carbon fiber string wound around the outer circumference of the glass-fiber-reinforcing layer along a spiral path and cemented by a resin.

2. The reinforcing structure as defined in claim 1, further comprising a prepreg-reinforcing layer between the glass-fiber-reinforcing layer and carbon-fiber-reinforcing layer, the prepreg-reinforcing layer comprising prepreg strings disposed parallel to the center axis of the cylinder barrel and cemented by a resin.

3. The reinforcing structure as defined in claim 1, further comprising a resin layer which adheres the glass-fiber-reinforcing layer onto the outer circumference of the sheet metal liner.

4. The reinforcing structure as defined in claim 1, wherein the cloth is a plain cloth covering the sheet metal liner and cemented by a resin, the plain cloth comprising warp yarn and weft yarn both of which are made of glass fiber, wherein the warp yarn is arranged parallel to a center axis of the cylinder barrel and the weft yarn is arranged along a circumferential direction of the cylinder barrel.

* * * * *